US011094307B2

(12) United States Patent
Sakata

(10) Patent No.: US 11,094,307 B2
(45) Date of Patent: Aug. 17, 2021

(54) ELECTRONIC MUSICAL INSTRUMENT AND METHOD OF CAUSING ELECTRONIC MUSICAL INSTRUMENT TO PERFORM PROCESSING

(71) Applicant: CASIO COMPUTER CO., LTD., Tokyo (JP)

(72) Inventor: Goro Sakata, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/591,588

(22) Filed: Oct. 2, 2019

(65) Prior Publication Data

US 2020/0111463 A1 Apr. 9, 2020

(30) Foreign Application Priority Data

Oct. 4, 2018 (JP) ..... JP2018-189361

(51) Int. Cl.
*G10H 1/14* (2006.01)
*G10H 1/00* (2006.01)
(Continued)

(52) U.S. Cl.
CPC ..... *G10H 1/14* (2013.01); *G10H 1/0008* (2013.01); *G10H 1/344* (2013.01); *G10H 7/008* (2013.01); *G10H 2220/221* (2013.01)

(58) Field of Classification Search
CPC ..... G10H 1/14; G10H 1/0008; G10H 1/344; G10H 7/008; G10H 2220/221
(Continued)

(56) References Cited

U.S. PATENT DOCUMENTS 4,463,647 A * 8/1984 Luce ..... G10H 1/02 84/684
5,136,916 A * 8/1992 Shibukawa ..... G10H 1/06 84/627
(Continued)

FOREIGN PATENT DOCUMENTS

JP S6055398 A 3/1985
JP S61204698 A 9/1986
(Continued)

OTHER PUBLICATIONS

Extended European Search Report (EESR) dated Feb. 4, 2020 issued European Application No. 19201062.7.
(Continued)

*Primary Examiner* — Christina M Schreiber
(74) *Attorney, Agent, or Firm* — Holtz, Holtz & Volek PC

(57) ABSTRACT

An electronic musical instrument includes a playing operator, and a sound source which performs processing of receiving, in response to a user operation on the playing operator, a sound generation instruction according to playing operation information including the pitch information indicating the certain pitch and sound volume information indicating a certain volume, and generating sound according to the certain pitch and the certain volume, based on excitation data generated by multiplying partial data by a window function, the partial data being included in excitation signal waveform data generated based on a plurality of waveform data items which are respectively different from each other in sound intensity in the certain pitch.

21 Claims, 11 Drawing Sheets

(51) Int. Cl.
*G10H 1/34* (2006.01)
*G10H 7/00* (2006.01)

(58) Field of Classification Search
USPC ..... 84/609
See application file for complete search history.

(56) References Cited

U.S. PATENT DOCUMENTS 5,428,185 A * 6/1995 Kunimoto ..... G10H 5/007 84/658
5,541,357 A * 7/1996 Sato ..... G10H 1/0575 84/604
6,031,173 A * 2/2000 Ikeda ..... G10H 7/002 84/605
6,184,453 B1 * 2/2001 Izumisawa ..... G10H 1/125 84/604
6,307,140 B1 * 10/2001 Iwamoto ..... G10H 1/36 84/622
6,421,642 B1 * 7/2002 Saruhashi ..... G10H 7/02 704/268
2003/0213357 A1 * 11/2003 Sasaki ..... G10H 7/002 84/609
2006/0111908 A1 * 5/2006 Sakata ..... G10L 13/033 704/258
2009/0000462 A1 * 1/2009 Fujita ..... G10H 1/0091 84/604
2011/0015931 A1 * 1/2011 Kawahara ..... G10L 21/00 704/264
2012/0240750 A1 * 9/2012 Kakishita ..... G10H 5/007 84/604
2015/0059557 A1 * 3/2015 Sakata ..... G10H 1/34 84/609
2015/0243291 A1 * 8/2015 Shirahama ..... G10H 1/08 704/500
2018/0182365 A1 * 6/2018 Sakata ..... G10H 1/0008
2019/0096376 A1 * 3/2019 Sakata ..... H03M 7/3037
2020/0111463 A1 * 4/2020 Sakata ..... G10H 7/02

FOREIGN PATENT DOCUMENTS

JP S62120797 U 7/1987
JP H04301899 A 10/1992
JP H05134677 A 5/1993
JP H06250662 A 9/1994
JP H11126080 A 5/1999
JP 2000231382 A 8/2000
JP 2004053932 A 2/2004
JP 2011154394 A 8/2011
JP 2012203145 A 10/2012

OTHER PUBLICATIONS

Japanese Office Action (and English language translation thereof) dated Aug. 4, 2020 issued in Japanese Application No. 2018-189361.
European Office Action dated Jun. 18, 2021, issued in European Application No. 19201062.7.

* cited by examiner

ELECTRONIC MUSICAL INSTRUMENT AND METHOD OF CAUSING ELECTRONIC MUSICAL INSTRUMENT TO PERFORM PROCESSING

CROSS-REFERENCE TO RELATED APPLICATIONS

This application is based upon and claims the benefit of priority from Japanese Patent Application No. 2018-189361, filed Oct. 4, 2018, the entire contents of which are incorporated herein by reference.

BACKGROUND OF THE INVENTION

1. Field of the Invention

The present invention relates to an electronic musical instrument and a method of causing the electronic musical instrument to perform processing.

2. Description of the Related Art

Jpn. Pat. Appln. KOKAI Publication No. 2011-154394 provides a technique for providing a musical sound generating apparatus which simulates key-released string vibration sound and case body resonance sound of an acoustic piano.

A technique has been known, which enables simplification of a circuit configuration including a memory capacity by the adoption of a configuration in which, in a PCM sound source, short waveform data read from a memory is processed as an excitation signal while cyclically giving appropriate attenuation to the data in a delay loop circuit, thereby generating musical sound having a predetermined length.

In a PCM sound source of this type, the type of waveform data that should be used as an excitation signal has not been established. In addition, when constructing a physical model corresponding to an excitation signal, the technique has not reached a point where musical sound with the desired real sound quality can be obtained; for example, a number of parameter settings are required.

SUMMARY OF THE INVENTION

According to one aspect of the present invention, there is provided an electronic musical instrument comprising: a playing operator with which pitch information indicating a certain pitch is associated; and a sound source which performs processing of: receiving, in response to a user operation on the playing operator, a sound generation instruction according to playing operation information including the pitch information indicating the certain pitch and sound volume information indicating a certain volume, and generating sound according to the certain pitch and the certain volume, based on excitation data generated by multiplying partial data by a window function, the partial data being included in excitation signal waveform data generated based on a plurality of waveform data items which are respectively different from each other in sound intensity in the certain pitch.

According to the present invention, it is possible to generate musical sound with a real sound quality without increasing the circuit scale.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, an embodiment in the case where the present invention is applied to an electronic keyboard musical instrument will be described with reference to drawings.

Figure 1:
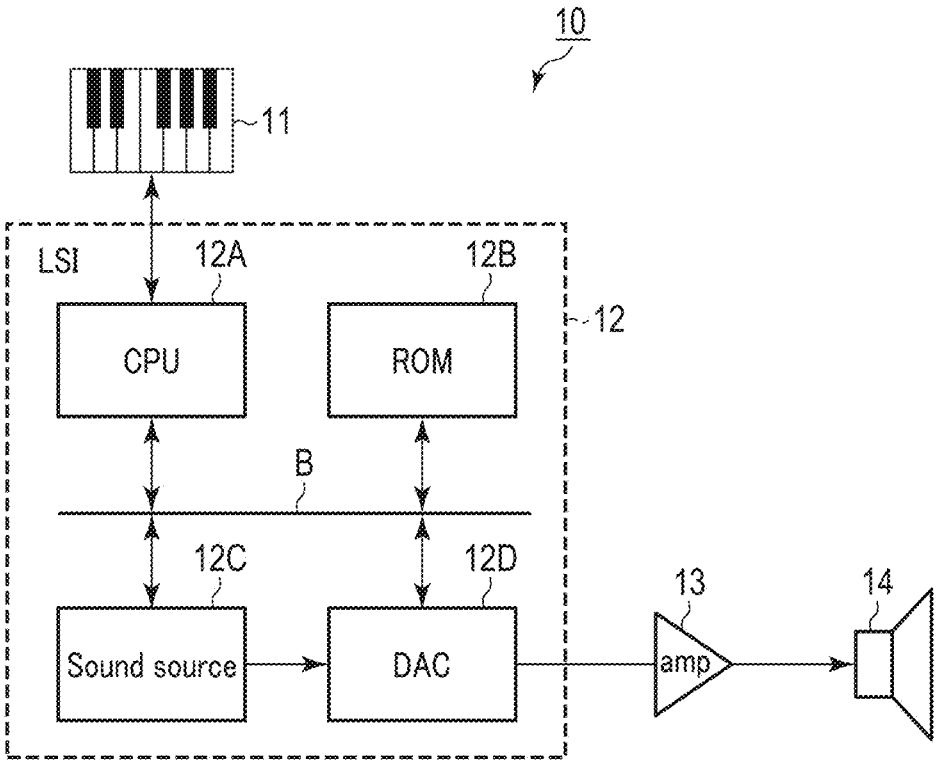
FIG. 1 is a block diagram showing the configuration of a basic hardware circuit of an electronic keyboard musical instrument according to an embodiment of the present invention.

FIG. 1 is a block diagram showing the configuration of a basic hardware circuit of an electronic keyboard musical instrument 10 according to the embodiment. In the same figure, an operation signal including a note number (pitch information) and a velocity value (key-pressing speed) as sound volume information, which is generated according to the operation at a keyboard 11 having playing operators (keys), is input in CPU12A of LSI12.

LSI12 connects, via a bus B, CPU12A, ROM12B, a sound source 12C, and a D/A converting unit (DAC) 12D.

The CPU 12A controls overall operations of the electronic keyboard musical instrument 10. The ROM12B stores excitation signal waveform data, etc. for operation programs or playing (music performance) performed by the CPU12A. The CPU12A gives a parameter, such as a note number and a velocity value, to the sound source 12C during the playing operation.

In response to the parameter given from the CPU12A, the sound source 12C reads partial data based on necessary excitation signal waveform data from the ROM12B, generates a musical sound signal through signaling processing, and outputs the generated musical sound signal to the D/A converting unit 12D.

The D/A converting unit 12D analogizes the musical sound signal and outputs it to an amplifier 13. A speaker 14 speech-amplifies and emits musical sound by means of the analogue musical sound signal amplified by the amplifier 13.

Figure 2:
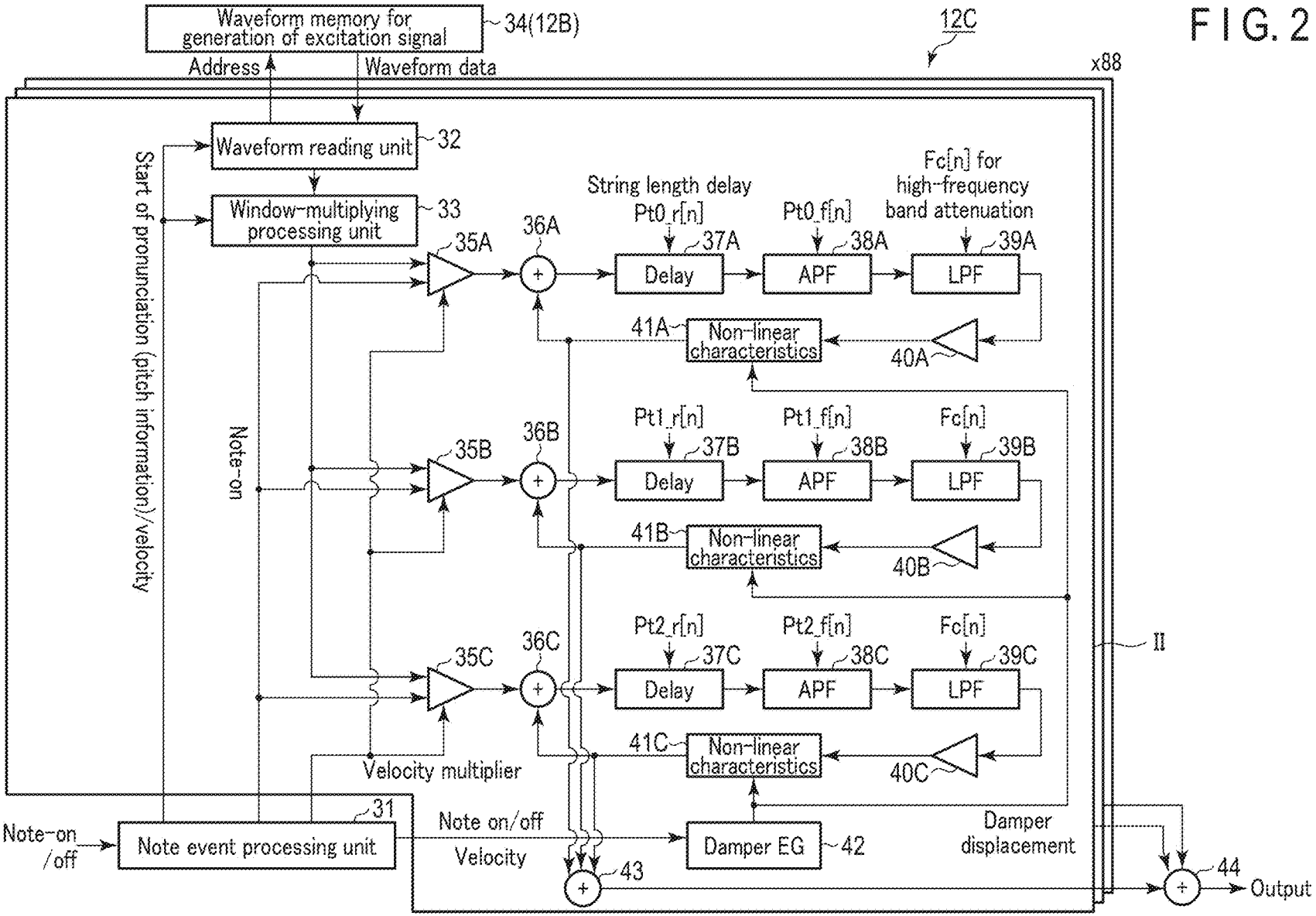
FIG. 2 is a block diagram showing the configuration of a sound source circuit according to the embodiment.

FIG. 2 is a block diagram primarily showing a detailed circuit configuration of the sound source 12C. In FIG. 2, the range shown by II, excluding a note event processing unit 31, a waveform memory 34, and an adder 44 (to be described later), corresponds to a single key included in the keyboard. In this electronic keyboard musical instrument 10, circuits for 88 keys (each the same as the circuit described above) are provided, based on the assumption that there are 88 keys in the keyboard 11.

Also, the electronic keyboard musical instrument 10 includes a signal circulation circuit of a string model with one string per key (lowest register), two strings per key (lower register), or three strings per key (medium or higher register). In FIG. 2, a circuit II for a key having a signal circulation circuit of a model of three strings is extracted and illustrated.

A note on/off signal according to an operation of a key at the keyboard 11 is input from the CPU12A to the note event processing unit 31.

In response to the key operated, the note event processing unit 31 sends respective pieces of information on a note number and a velocity value, at the point of the start of sound emission (note-on), to a waveform reading unit 32 and a window-multiplying processing unit 33, and sends a multiplier according to the note-on signal and velocity value to gate amplifiers 35A to 35C in each of the string models.

Furthermore, the note event processing unit 31 sends a note-on/off signal and a velocity value signal to a damper envelope generator (EG) 42.

The waveform reading unit 32 generates a reading address according to information on the note number and velocity value, and reads waveform data as an excitation signal from the waveform memory 34.

Figure 4:
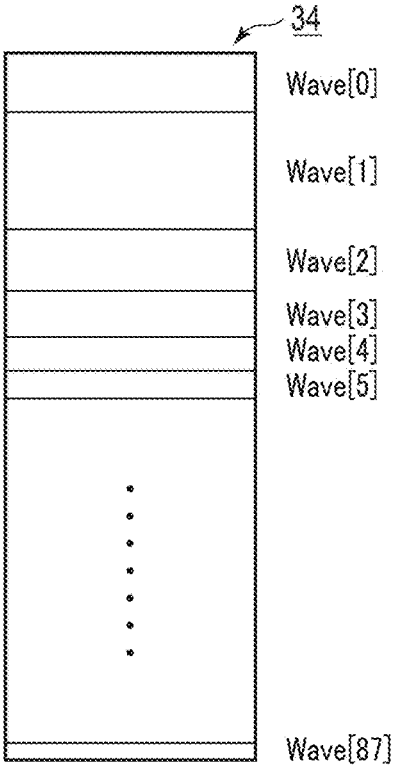
FIG. 4 is a diagram illustrating waveform data for excitation signal waveform data for 88 keys to be stored in a waveform memory according to the embodiment.

FIG. 4 illustrates excitation signal waveform data for 88 keys stored in the waveform memory 34. Wave (0) is waveform data of the lowest sound, and Wave (87) is waveform data of the highest sound. When storing waveform data for only the same wavelength, waveform data corresponding to a lower note number has longer waveform data than waveform data corresponding to a higher note number, and has a larger occupied area in the memory, since lower sound has a longer wavelength.

An address value, to which a value offset in each Wave (n) is added according to a velocity value of sound emission, is given in accordance with a pitch of sound pronunciation as an offset address to any one of the leading addresses in the excitation signal waveform data of 88 sounds.

The waveform reading unit 32 outputs partial data read out from the waveform memory 34 to the window-multiplying processing unit 33.

The window-multiplying processing unit 33 performs window-multiplying (window function) processing in a time width corresponding to a wavelength of the pitch according to the note number from the note number information, and sends the window-multiplying processed waveform to the gate amplifiers 35A to 35C.

Hereinafter, the subsequent step of one of the signal circulation circuits of the model with three strings, e.g., the gate amplifier 35A of the highest step side, is cited and explained as an example.

In the gate amplifier 35A, the window-multiplying processed waveform data is subjected to amplification processing using a multiplier according to a velocity value, and the processed waveform data is output to an adder 36A. Waveform data to which attenuation according to the damper displacement is given, output by a non-linear characteristic processing unit 41A to be described later, has been returned to, and also input in, the adder 36A, and the addition output is sent to a delay circuit 37A.

In the delay circuit 37A of the acoustic piano, a string length delay PT0_*r* [n] has been set as a value according to an integer part of a single wavelength of sound output when the string vibrates (e.g., an integer "20" when the sound corresponds to a high note key; and an integer "2000" when the sound corresponds to a low note key), and the delay circuit 37A delays the waveform data by only the string length delay PT0_*r* [n] and outputs the waveform data to an all-pass filter (APF) 38A in the subsequent step.

In the all-pass filter 38A, a string length delay PT0_*f* [n] has been set as a value according to a decimal part of the single wavelength, and the all-pass filter 38A delays the waveform data by only the string length delay PT0_*f* [n] and outputs the waveform data to a low-pass filter (LPF) 39A in the subsequent step. That is, the waveform data is delayed, by the delay circuit 37A (to 37C) and the all-pass filter 38A (to 38C), for the time determined in accordance with the input note number information (pitch information) (the time for a single wavelength).

The low-pass filter 39A passes the waveform data on the low-frequency side by using a cutoff-frequency Fc [n] for high-frequency band attenuation set for the frequency of the string length, and outputs the waveform data to an attenuation amplifier 40A.

The attenuation amplifier 40A performs normal attenuation processing irrelevant to damper displacement, and outputs the attenuated waveform data to a non-linear characteristic processing unit 41A.

The non-linear characteristic processing unit 41A attenuates waveform data after note-off (instructions for weakening sound, including sound-deadening) based on the information of damper displacement given from the damper envelope generator (EG) 42, outputs the attenuated waveform data to the adder 36A as described above, and further outputs it to an adder 43.

The adder 43 performs addition processing of the waveform data output by the non-linear characteristic processing unit 41A and non-linear characteristic processing units 41B and 41C of the other two lines similarly constituting the circulation circuit for excitation signals, and outputs the sum as a musical sound signal according to the operation of the key to the adder 44.

The adder 44 adds a musical sound signal corresponding to each pressed key, and outputs the sum to a D/A converting unit 12D in the subsequent step.

Figure 3:
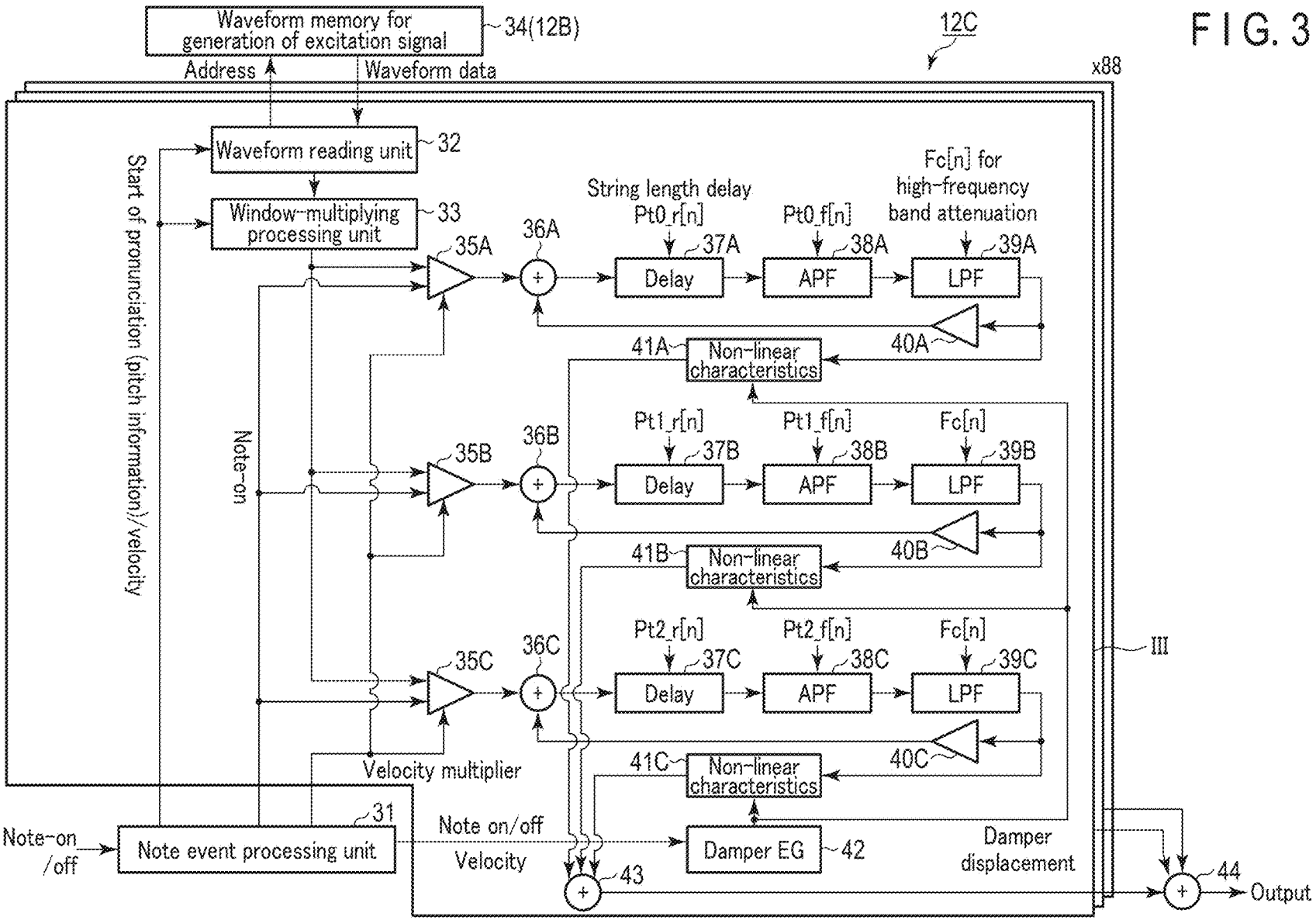
FIG. 3 is a block diagram showing another configuration of the sound source circuit according to the embodiment.

FIG. 3 is a block diagram primarily showing another detailed circuit configuration of the source 12C instead of the circuit configuration shown in FIG. 2. In FIG. 3, the signal circulation circuit of each of the string models is a circulation circuit in which waveform data after natural attenuation, output by an attenuation amplifier 40A (to 40C), is output to the non-linear characteristic processing unit 41A (to 41C) and directly returned to the adder 36A (to 36C).

In this way, by venturing not to include the non-linear characteristic processing unit 41A (to 41C) in a closed-loop circuit of the circulating string model, it is possible to set a multiplier as an attenuation multiplying device in the closed loop to an appropriate value at the point of key-release, and stabilize the processing without the attenuation due to a damper. This is caused by the non-linear characteristic processing unit 41A (to 41C) which act(s) according to the amount of the damper displacement, excessively applied through the closed-loop circuit.

In addition, the provision of the attenuation due to a damper out of the closed-loop circuit as illustrated in FIG. 3 becomes particularly suitable when reproducing the musical sound of a musical instrument which outputs sound generated by picking up vibrations of strings like electric guitars, for example.

On the other hand, the case where the attenuation due to a damper is provided inside a closed-loop circuit as shown in FIG. 2 becomes particularly suitable when reproducing the musical sound of a musical instrument which directly outputs vibrations of strings like an acoustic piano, for example.

An electronic keyboard musical instrument may be made which enables the selection of a mode through a user's discretional mode switching operation, setting the case of providing attenuation due to a damper inside a closed-loop circuit to a first mode and setting the case of providing attenuation due to a damper out of a closed-loop circuit to a second mode, although this musical instrument is not adopted in the present embodiments.

Figure 5:
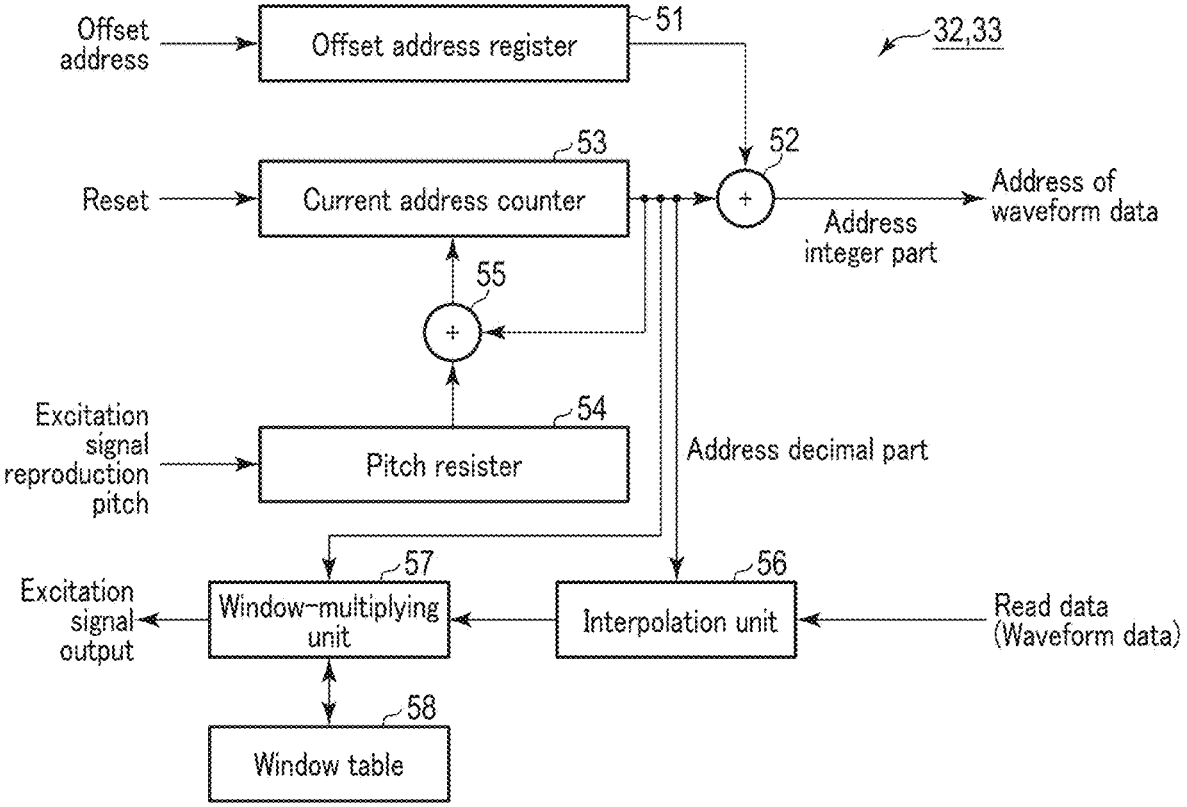
FIG. 5 is a block diagram showing the circuit configuration of a waveform reading unit and a window-multiplying processing unit, according to the embodiment.

FIG. 5 is a block diagram showing the circuit configuration of the waveform reading unit 32 and the window-multiplying processing unit 33.

When a key in the keyboard 11 is pressed, an offset address indicating a leading address according to a note number that should be pronounced, and a velocity value are retained in an offset address register 51. The retained content of the offset address register 51 is output to an adder 52.

Meanwhile, a count value of a current address counter 53 which is reset at the beginning of sound emission to become "0 (zero)" is output to the adder 52, an interpolation unit 56, an adder 55, and a window-multiplying unit 57.

The count address counter 53 is a counter which sequentially increases a count value based on a result obtained by adding, via the adder 55, a retained value at a pitch register 54 which retains a reproduced pitch of an excitation signal and the count value itself.

In the normal case, when a sampling rate of waveform data in the waveform memory 34 agrees with its string model, a reproduced pitch, which is a set value of the pitch register 54, becomes "1.0"; however, when the pitch is changed by master tuning, stretch tuning, rhythm, or the like, a value added to or subtracted from "1.0" is given as the reproduced pitch.

The output (address integer part) of the adder 52, which adds an offset address to a current address, is output as a read-out address to the waveform memory 34, and corresponding waveform data is read out from the waveform memory 34.

The read-out waveform data is, in the interpolation unit 56, subjected to interpolation processing in accordance with an address decimal part according to the pitch output by the count address counter 53, and then output to the window-multiplying unit 57. The window-multiplying unit 57 performs window-Multiplying processing for the waveform data, based on a window function table, such as Hanning (hann/Humming) window, Black man window, stored in a window table 58, along with the progress of the current address output by the current address counter 53, and outputs the window-multiplying processed waveform data as an exciting signal to the gate amplifiers 35A to 35C.

Figure 6:
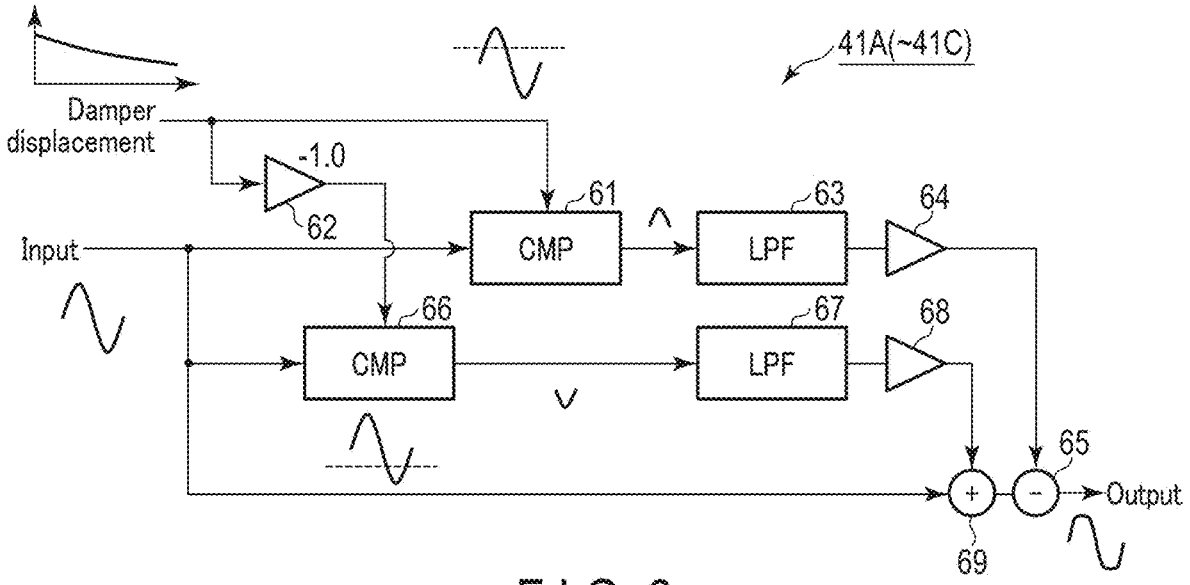
FIG. 6 is a block diagram showing the configuration of a non-linear characteristic processing unit shown in FIGS. 2 and 3, according to the embodiment.

FIG. 6 is a block diagram showing the configuration of the non-linear characteristic processing unit 41A (to 41C) constituting the signal circulation circuit of the string model. Naturally attenuated waveform data output by the attenuation amplifier 40A in the previous step and information on damper displacement from the damper envelope generator 42 is input.

The information on damper displacement has a curve waveform indicating attenuation in a plus-sign area as indicated in the figure, and while the information is directly input in a comparator (CMP) 61, the sign is reversed to (x−1) at a reversal amplifier 62, and the waveform information is input in a comparator 66.

The comparator 61 extracts a waveform portion larger than the information on damper displacement from the input of the waveform data and passes the waveform portion. After high-frequency components are removed from an output of the comparator 61 by a low-pass filter (LPF) 63, the output is amplified at a predetermined amplification rate by an amplifier 64, and is then given as a subtrahend to a subtracter 65.

On the other hand, the comparator 66 extracts a waveform portion smaller than the reversed information on damper displacement from the input of the waveform data and passes the waveform data. After high-frequency components are removed from an output of the comparator 66 by a low-pass filter (LPF) 67, the output is amplified at a predetermined amplification rate by an amplifier 68, and is then given to an adder 69.

The adder 69 adds, to the input waveform data, a maximal waveform portion on the minus side from the amplifier 68 to thereby obtain waveform data in which the maximal waveform portion is cut, and outputs the waveform to the subtracter 65.

The subtracter 65 subtracts a maximal waveform portion on the plus side output by the amplifier 64 from the waveform data from the adder 69 to thereby obtain waveform data in which the maximal waveform portion is cut.

As a result, the waveform data output from the subtracter 65 is returned to, and input in, the adder 36A in the subsequent step, as waveform data in which a portion exceeding the waveform range, given as information on damper information on both the plus side and the minus side, is suppressed.

Next, the operation of the embodiment will be described.

First, waveform data to be stored in the waveform memory 34 (ROM12B) will be described with reference to FIGS. 7 to 10.

Figure 7:
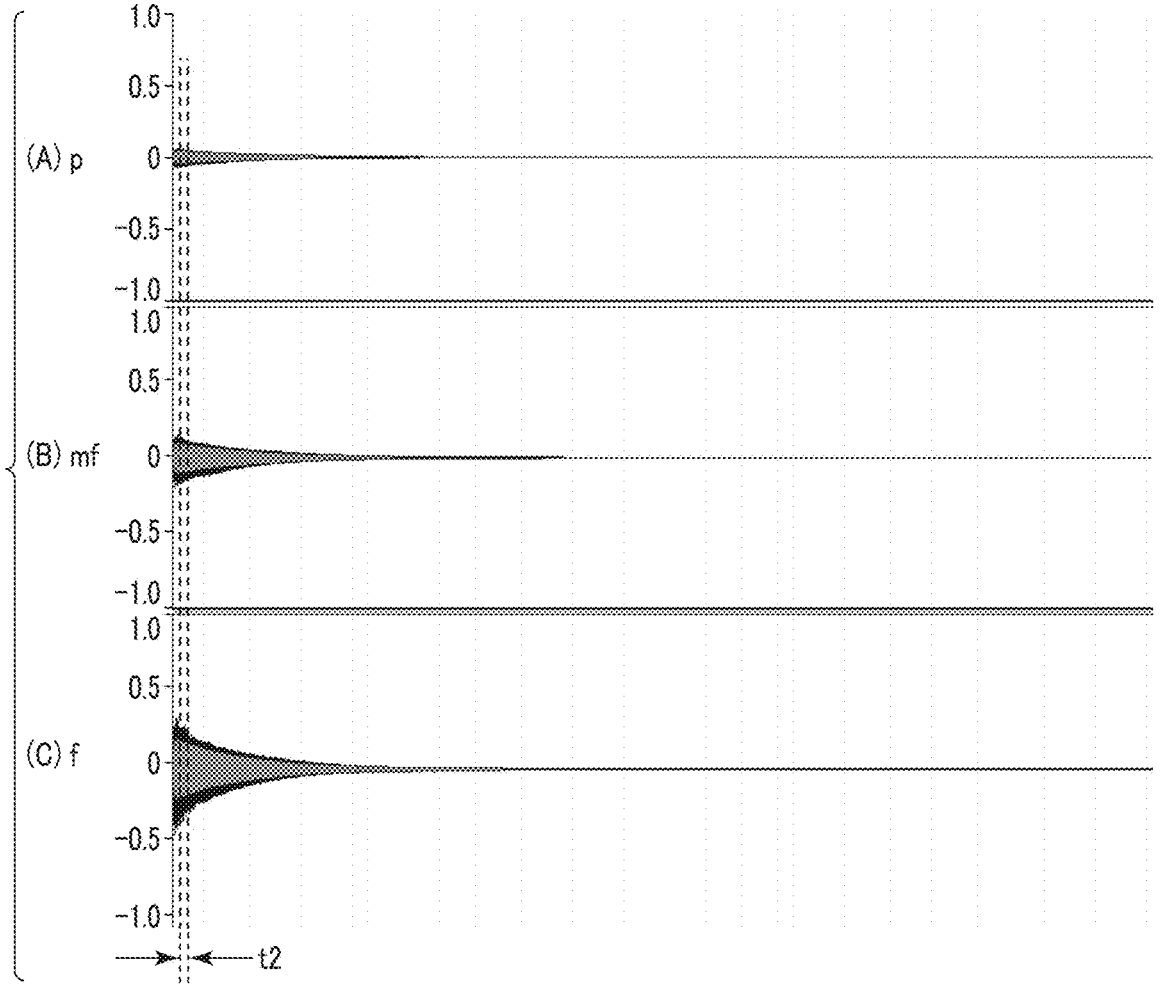
FIG. 7 is a diagram illustrating recorded and collected musical sound waveforms according to the embodiment, which are different in sound intensity (velocity value) in a certain key.

FIG. 7 is a diagram illustrating waveforms of recorded and collected musical sound having the same note number and different velocity values. (A) in FIG. 7 shows a waveform of a piano (p), (B) in FIG. 7 shows a waveform of mezzo forte (mf), and (C) in FIG. 7 shows a waveform of forte (f). In the modeling, it is desired to use only a portion which is close to the first portion of each waveform and a harmonic tone configuration is stabilized after an impact (t2-interval in the figure).

It is also desired to perform, as preprocessing, normalization processing for a plurality of these pieces of recorded data so as to have an equal amplification.

Figure 8A:
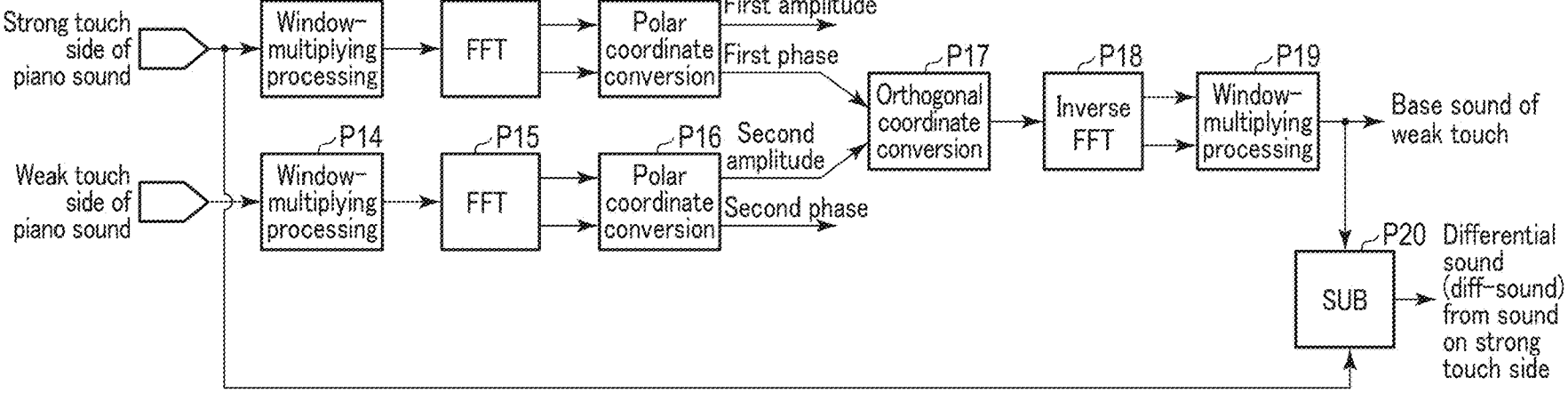
FIGS. 8A and 8B are diagrams illustrating the process of normalization processing given as preprocessing to waveform data, according to the embodiment.
Figure 8B:
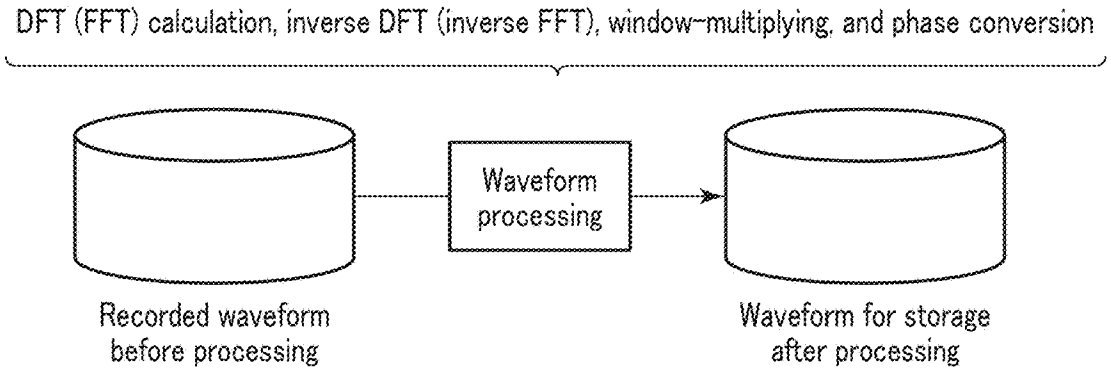

FIGS. 8A and 8B show a process of the preprocessing for the piano musical sound waveform data. In FIG. 8A, for simplification of the explanation, the waveform data is explained based on the assumption that a waveform on the strong touch (f) side and a waveform on the weak touch side (p) are processed.

The waveform data on the strong touch side is subjected to window-multiplying (window function) processing P11 and then subjected to a high-speed Fourier transformation (FFT) processing P12 as a discrete Fourier transformation (DFT), and then converted frequency-dimensionally to obtain a real value (R) and an imaginary value (I) of a complex number. These complex numbers are polar-coordinated by polar coordinate conversion processing P13 and converted into a first amplitude signal and first phase information.

The waveform on the weak touch side is similar to the waveform on the strong touch side, and second amplitude information and second phase information are obtained by window-multiplying (window function) processing P14, high-speed Fourier transformation (FFT) processing P15, and polar coordinate conversion processing P16.

Subsequently, the second phase information of the waveform on the weak-touch side is replaced by the first phase information on the strong-touch side and is converted into a complex number again by an orthogonal coordinate conversion processing P17. This complex number is processed into waveform data by an inversion high-speed Fourier transformation (inversion FFT) processing P18.

The obtained waveform data is further subjected to window-multiplying (window function) processing P19 to remove unnecessary waveform portions, and waveform data of weak-touch base sound is obtained.

Furthermore, by subjecting waveform data on the strong-touch side to subtraction processing using the waveform data of the weak-touch base sound as a subtrahend through subtraction processing P20, waveform data of differential sound different from the waveform data of the strong-touch side can be obtained.

FIG. 8B illustrates the acquisition of waveform data for being stored in the waveform memory 34 (ROM12B) by the performance of the waveform data processing shown in FIG. 8A.

Through the waveform processing as described above, overtone phases of a plurality of waveform data items can be respectively uniformed. In the case of combining strong-and-weak musical sounds of a particular musical instrument, the waveform processing also becomes effective in reducing the likelihood of causing a change in which an addition result of a plurality of pieces of recorded data, each different in musical sound intensity, differs from an addition rate.

Figure 9:
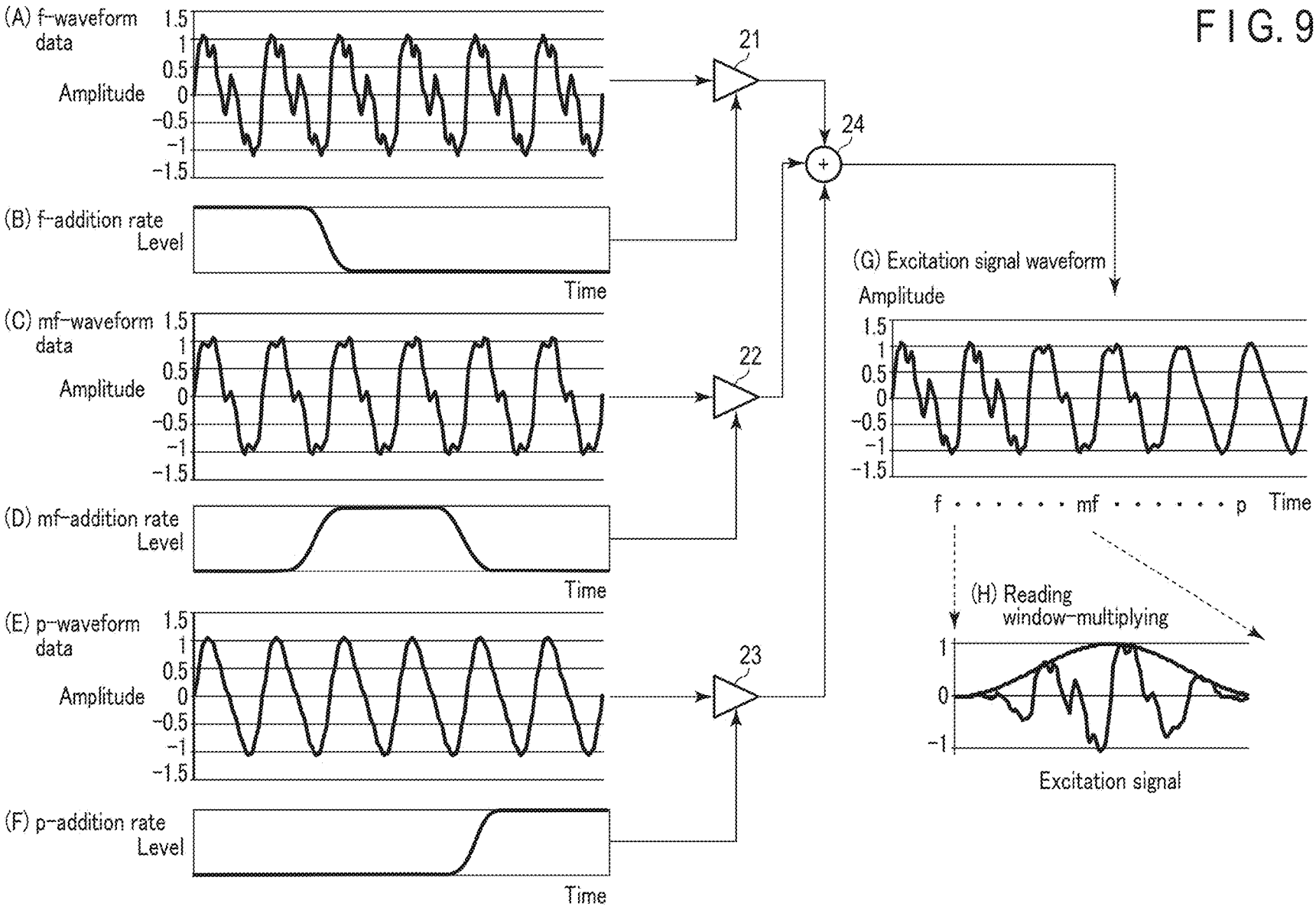
FIG. 9 is a diagram illustrating a method of generating excitation signals from an addition synthesis of strength waveforms, according to the embodiment.

FIG. 9 is a diagram illustrating a method of generating, in a pitch corresponding to a certain note number, an excitation signal from an addition synthesis of a strong-and-weak waveform. Data of a leading portion of the waveform data corresponding to the intensity of musical sound (strong-and-weak musical sounds) is added using each value shown by the addition rates in the figure, so that each of the musical sound intensities is changed along a temporal sequence similar to the progress of a stored address.

Specifically, FIG. 9 (A) shows waveform data of forte (f) which is high in intensity (i.e., sound intensity is high) for about six cycles. An addition rate signal for making the waveform data for about the first two cycles effective is given to this waveform data, as shown in FIG. 9 (B). Therefore, in a multiplying device (amplifier) 21, the waveform data is subjected to multiplication processing using, as a multiplier (amplification factor), the addition rate signal which varies between "1.0" to "0.0". This subjects the waveform data to multiplication processing, and waveform data as a product is output to an adder 24.

Similarly, FIG. 9 (C) shows waveform data of mezzo forte (mf) for about 6 cycles, which is second waveform data in which the intensity is moderate (i.e., sound intensity is slightly strong). An addition rate signal for making waveform data for about two cycles in the middle effective is given to this waveform data, as shown in FIG. 9 (D). Therefore, a multiplying device 22 performs multiplying processing of waveform data using the addition rate signal as a multiplier and outputs waveform data as a product to the adder 24.

Similarly, FIG. 9 (E) shows waveform data piano (p) for about six cycles. This is third waveform data in which the intensity is low (strength of sound is weak). An addition rate signal for making waveform data for the two cycles in the last portion effective is given to this waveform data, as shown in FIG. 9 (F). Therefore, the multiplier 23 performs multiplying processing of waveform data using the addition rate signal as a multiplier, and outputs waveform data as a product to the adder 24.

Therefore, an output of the adder 24 which adds these waveform data sequentially changes in waveform from "strong" to "moderate" to "weak" for every two cycles.

Such waveform data (excitation signal waveform data) is preliminarily stored in the waveform memory 34, and a start address according to the intensity of playing (music performance) is designated, thereby ensuring that necessary waveform data (partial data) is read as an excitation signal. The read waveform data is subjected to window-multiplying processing by a window-multiplying processing unit 33 as shown in FIG. 9 (H), and supplied to respective signal circulation circuits in the subsequent step.

Since waveform data for a portion of two to three wavelengths is used, the numbers of pieces sampling data constituting the waveform data differ depending on the pitch. For example, in the case of 88 keys of an acoustic piano, the number of pieces of sampling data from low pitch sound (low note) to high pitch sound (high note) is approximately 2000 to 20 or so (in the case of sampling frequency: 44.1 [kHz]).

The addition method of waveform data is not limited to combinations of waveform data which differ in the intensity of playing (music performance) of only the same musical instrument. For example, in the case of an electric piano, although when keys are touched weakly the resulting waveform data has waveform characteristics close to those of a sinusoidal wave, when the keys are touched strongly the resulting waveform data has a waveform akin to a saturated rectangular wave. It is possible to generate musical sound in a model which sequentially changes sound, by means of the intensity of playing or other playing operators, by sequentially adding various different musical sounds of a musical instrument, such as these waveforms apparently different in shape, e.g., waveforms extracted from a guitar.

Figure 10:
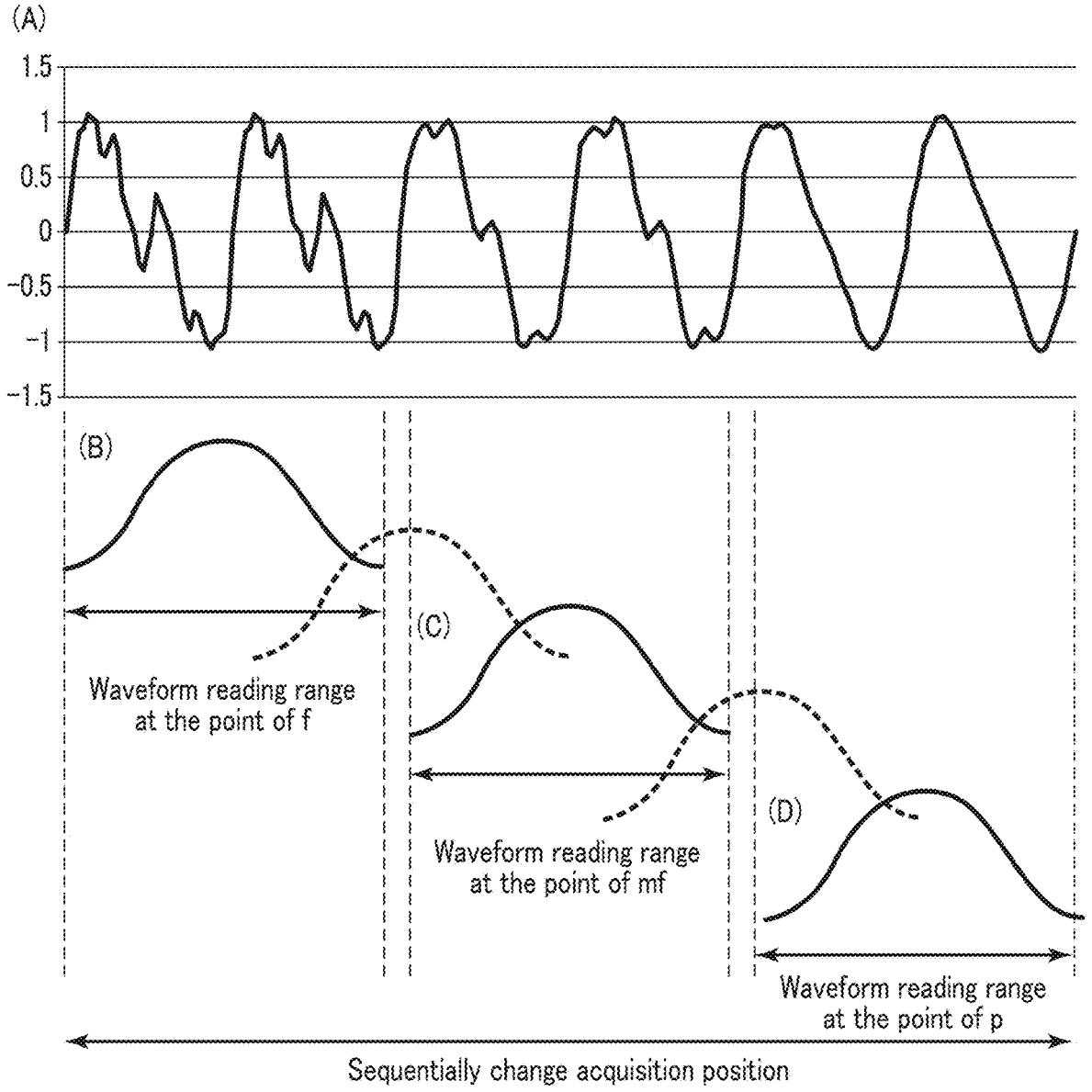
FIG. 10 is a diagram illustrating the process of changing a read address of a waveform memory in accordance with a velocity value, according to the embodiment.

FIG. 10 illustrates a process in which when the sound source 12C is driven, the waveform reading unit 32 changes a read address of the waveform memory 34 in accordance with a velocity value. As shown in FIG. 10 (A), such waveform data that is sequentially changing from forte (f) to piano (p) is preliminarily stored in the waveform memory 34, and a read-start address is changed to read out a waveform data portion according to the velocity value during playing.

FIG. 10 (B) shows a read range of waveform data when the velocity value corresponds to forte (f); FIG. 10 (C) shows a read range of waveform data when the velocity value corresponds to mezzo-forte (mf); and FIG. 10 (D) shows a read range of waveform data when the velocity value corresponds to piano (p).

Actually, the number of steps is not limited to the three steps described above, as shown by a dotted line in a window-multiplying waveform in the figure; for example, when the resolution of the velocity value is 7 bits, the number of steps is divided into 128 steps, and the read-out position of waveform data using the note number is sequentially changed.

When subjecting the read waveform data to window-multiplying processing, the wavelength differs depending on the tone interval, and therefore, it is necessary to also make the time length for the portion subjected to the window-multiplying processing different.

Figures 11A, 11B, 11C:
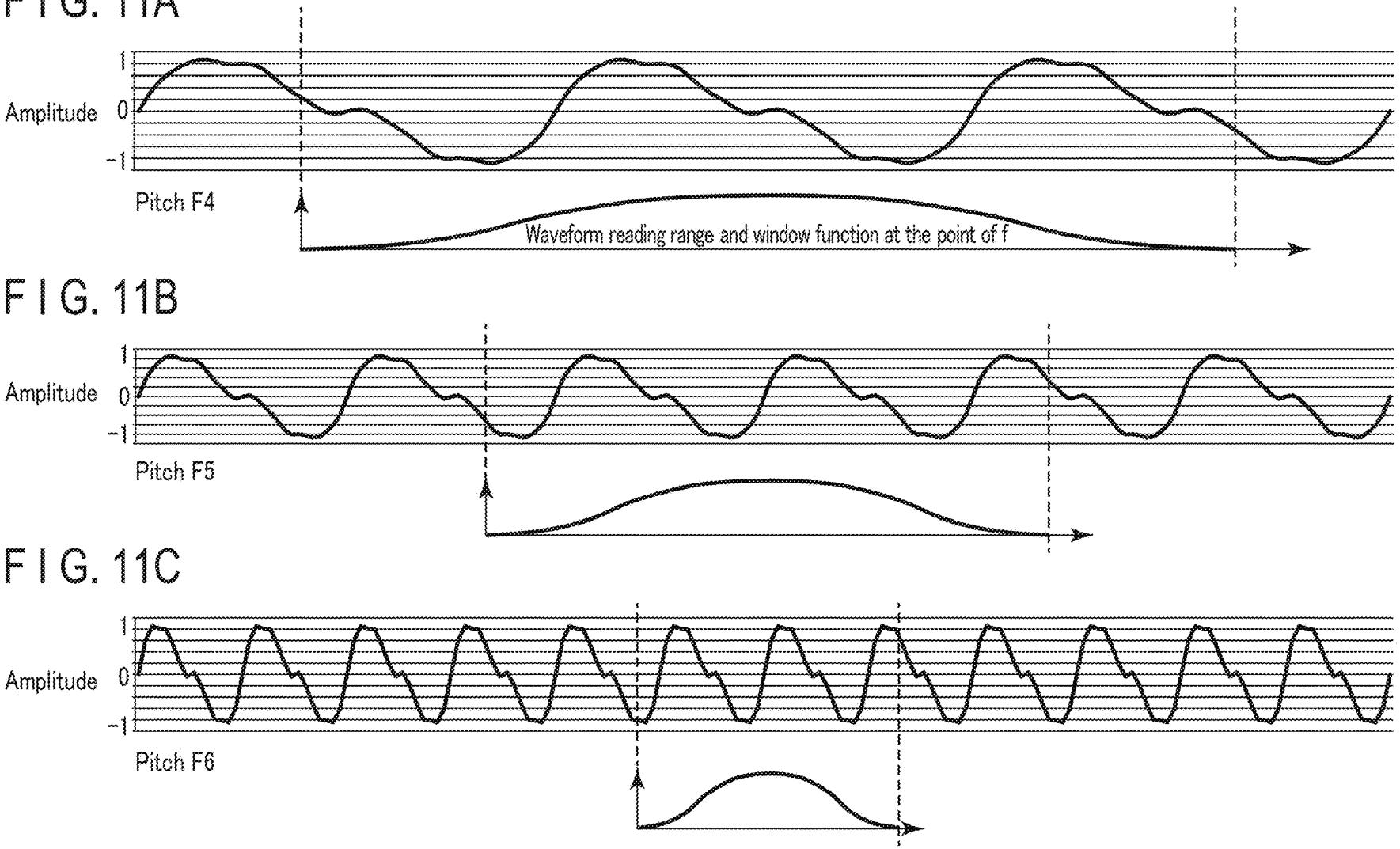
FIGS. 11A, 11B, and 11C are diagrams illustrating the relationship of a window function in accordance with a wavelength (pitch), according to the embodiment.

FIGS. 11A, 11B, and 11C are diagrams each illustrating the relationship of a window function according to a waveform (pitch). FIG. 11A shows a waveform read range and a window function for waveform data of forte (f) in the case of a pitch F4 (MIDI: 65). Similarly, FIG. 11B shows a waveform read range and a window function for waveform data in the case of a pitch (F5 (MIDI: 77) which is one-octave higher than the waveform data shown in FIG. 11A, and FIG. 11C shows waveform data in the case of a pitch (F6 (MIDI: 89) which is a further one-octave higher than the waveform data shown in FIG. 11B.

As shown in each of the figures, when a result of subjecting waveform data stored in the waveform memory 34 to window-multiplying processing is used as an excitation signal, the time width of a waveform differs depending on a pitch according to a designated note number, and therefore, it is also necessary to change the size (time width) with which the window-multiplying is performed in accordance with the a designated note number.

In addition to subjecting the waveform data read from the waveform memory 34 by the waveform reading unit 32 to the window-multiplying processing through the window-multiplying processing unit 33 as described above, it is assumed that the waveform data itself stored in the waveform memory 34 has been preliminarily subjected to the window-multiplying processing, and unnecessary frequency components have been removed therefrom as explained above in FIGS. 8A and 8B.

For a window function used herein for the waveform data to be stored, a function which has less influence on overtone components of original sound of musical sound, such as a Hanning (hann/Hamming) window, a Blackman window, and a Kaiser window, is sufficient.

The waveform data which is read from the waveform memory 34 by the waveform reading unit 32 and subjected to the window-multiplying processing by the window-multiplying processing unit 33 is processed using a multiplier according to an operated velocity value through the gate amplifiers 35A to 35C, and then input in a signal circulation circuit constituting the string model.

A single string model is composed of a closed-loop including a delay circuit 37A (to 37C) which generates delay for a waveform portion of musical sound to be generated, and the inside of the loop includes an all-pass filter 38A (to 38C), a low-pass filter 39A (to 39C), an attenuation amplifier 40A (to 40C), a non-linear characteristic processing unit 41A (to 41C), and an adder 36A (to 36C) which adds excitation signals of signals of the model.

In relation to the matter that the delay circuit 37A (to 37C) and the all-pass filter 38A (to 38C) delay a value in which an inverse number of a dismal part of a pitch frequency of musical sound to be generated and an integer 1 are added by means of digital processing to the delay circuits 37A (to 37C), while an integer part of the wavelength is given as a string delay PT0_*r* [n] (to PT2_*r* [n]), a decimal part of the wavelength is given as a string delay PT0_*f* [n] (to PT2_*f* [n]) to the all-pass filter 38A (to 38C).

As described above, FIGS. 2 and 3 each show a configuration of a circuit corresponding to key positions of medium registers to higher registers, provided with a string model in which three strings are provided for a single key in conformity to an acoustic piano.

In the case of an acoustic piano, the degree of adjustment of pitches of these three strings of this model is referred to as "unison", and it is set to pitches minutely different from one another. These different pitches are parameters adjusted depending on a piano to be modeled.

A cut-off frequency Fc [n] to the low-pass filter 39A (to 39C) which adjusts the time from pronunciation (sound emission), as well as the attenuation of overtone components, is also set in accordance with a piano and strings to be modeled, similarly.

An output of each string model is added by an adder 43, outputs for 88 keys are further added to the output by an adder 44, and the resulting data is output to a D/A converting unit 12D in the subsequent step.

Waveform data which becomes a signal exciting the string model of a closed-loop is read out from the waveform memory 34 by the waveform reading unit 32 and subjected to window-multiplying processing by the window-multiplying processing unit 33, and then, in the gate amplifiers 35A to 35C. The processed signal is multiplied by a multiplier according to the velocity value, and supplied to respective signal circulation circuits constituting the string model.

At the point of note-on (key-pressing), a note-on signal is sent from a note event processing unit 31 to a damper envelope generator 42, and the damper envelop generator 42 converts the note-on signal into a signal indicating the displacement of a damper, sending it to the non-linear characteristic processing units 41A to 41C.

Specifically, the suppression of vibrations of the strings is temporarily released. Immediately after that, the waveform reading unit 32 is controlled so as to read the waveform data as an excitation signal, in accordance with the note number and the velocity value.

In response to the occurrence of note-off (upon receipt of instructions for weakening sound including sound deadening) at the point of key-release, the damper envelope generator 42 adjusts information on the damper displacement at a speed according to a note-off velocity value so that an attenuation coefficient is adjusted by the non-linear characteristic processing units 41A to 41C as multiplying devices for attenuation furnished inside the closed-loop.

Specifically, the damper envelope generator 42 adjusts vibrations in such a direction that with a strong note-off velocity value, the vibrations of strings attenuate quickly, and with a weak note-off velocity value, the damper suppress the strings to slowly suppress the vibrations.

It should be noted that a note-off event is generally expressed by a velocity value; however, a configuration whereby a signal value sequentially changes like the control data of MIDI is given to the non-linear characteristic processing units 41A to 41C may also be adopted.

Figure 12:
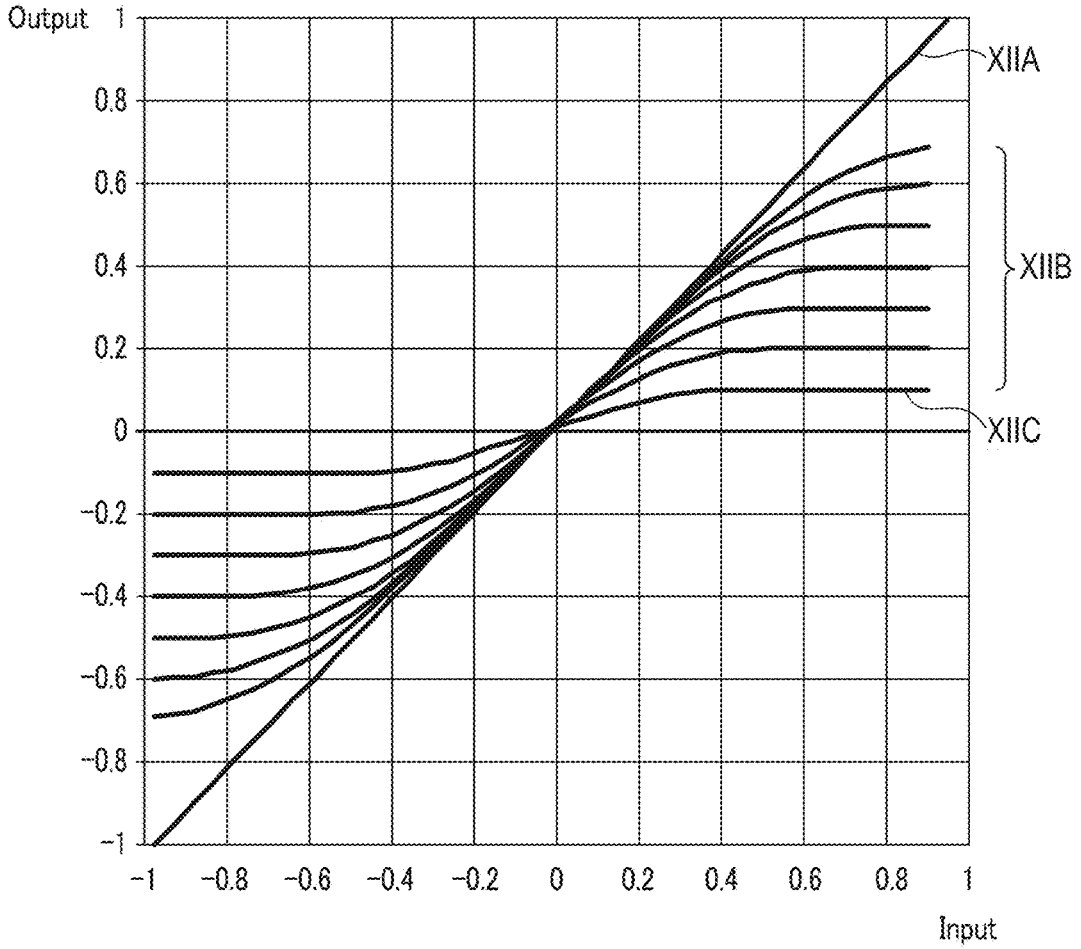
FIG. 12 is a diagram showing an example of attenuation characteristics at the non-linear characteristic processing unit according to the embodiment.

FIG. 12 is a diagram showing an example of attenuation characteristics in the non-linear characteristic processing units 41A to 41C. In the figure, the horizontal axis denotes an input, and the vertical axis denotes an output.

At the time of note-on, in a state where a string is released from a damper, the attenuation rate of the string is 1.0, and as shown by XIIA in the figure, an input is equal to an output.

When the damper is displaced, gradually brought into contact with a string, and starts to absorb vibrating energy and suppress the vibrations, the displacement of the vibration (output) moves smoothly to a constant value from the displacement of the contacted string. As shown by XIIB in the figure, the amount of displacement that moves to a constant value varies in accordance with the change amount of the damper, and when the damper contacts the string more frequently, the vibration of the string is suppressed at a lower output level.

XIIC in the figure shows characteristics at the point of note-off and shows a state where the output is suppressed so as to be even smaller relative to the input.

Since dampers of a piano need to be designed to suppress the vibrations of strings without generating unnecessary sounds, the characteristics are adjusted so that a curve is drawn as smooth as possible, and the resulting output reaches a fixed output value.

In the actual non-linear characteristic processing units 41A to 41C, attenuation according to damper displacement as described above is realized by, for example, the circuit configuration shown in FIG. 5. In this case, if the cut-off frequencies of the low-pass filters 63, 66 constituting the non-linear characteristic processing units 41A to 41C have higher frequencies, overtone sound generated at the point of key-release increases with a lesser degree of smoothness.

For example, in the case where the musical instrument is a harpsichord, the sound at the point of key-release is clearly loud, and when the sound includes high-frequency components, the cut-off frequency is set to be higher. In contrast, when the amount of the overtone components generated at the point of key-release is small as in the case where the musical instrument is a piano, the cut-off frequency is set to be sufficiently lower.

Figure 13:
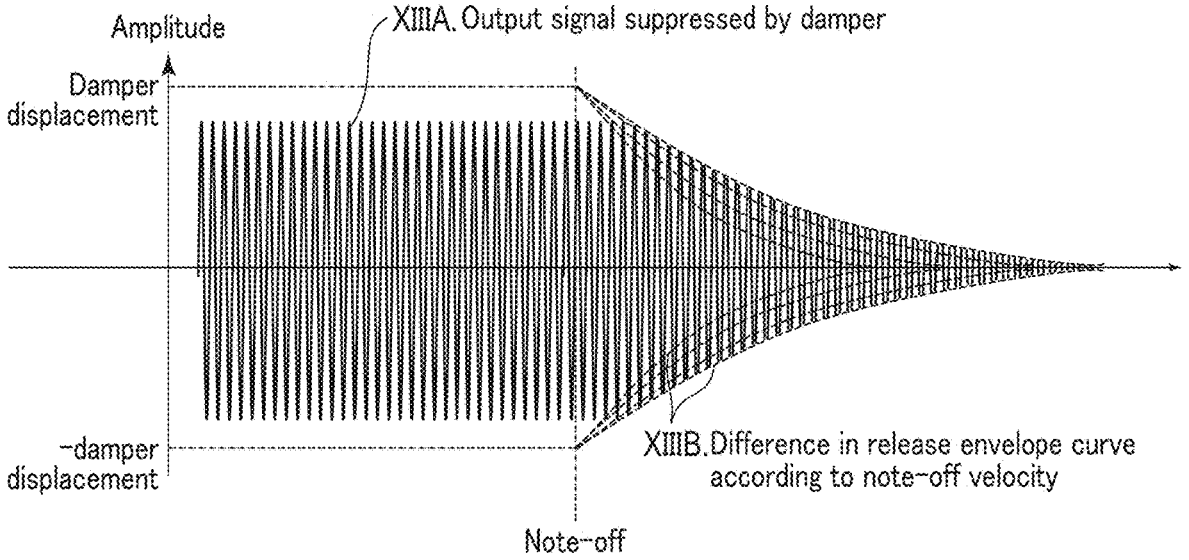
FIG. 13 is a diagram showing a damper displacement signal generated by a damper envelope generator and an envelope of a released waveform at the note-off time, according to the embodiment.

FIG. 13 is a diagram showing a damper displacement signal generated by the damper envelope generator at the point of note-off and an envelope having a waveform released. As shown in the same figure, until note-off is generated, an output signal suppressed by a damper is output only with a small amount of natural attenuation set at the attenuation amplifiers 40A to 40C, as shown by XIIIA in the figure.

At the point when it subsequently becomes note-off, the damper envelope generator 42 attenuates the damper displacement in accordance with the intensity of a velocity value at the point of note-off. In the figure, XIIIB indicates differences in release envelope curve depending on a velocity value at the point of note-off. The larger a velocity value (=the higher the speed of key-release), the larger a damper displacement amount is set to be, and the larger the attenuation amount. In accordance with attenuation of damper displacement, a string signal is attenuated while undergoing saturation, resulting in sound deadening.

Figure 14B:
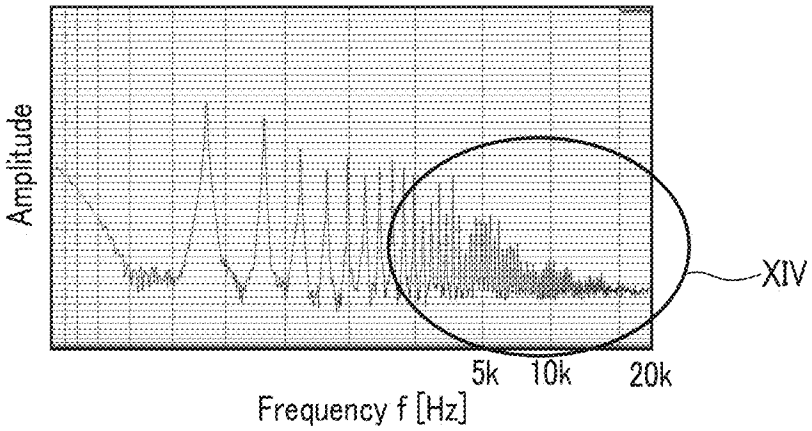
FIGS. 14A and 14B are diagrams illustrating a distribution change in frequency spectral characteristics at the point of key-release, according to the embodiment.
Figure 14A:
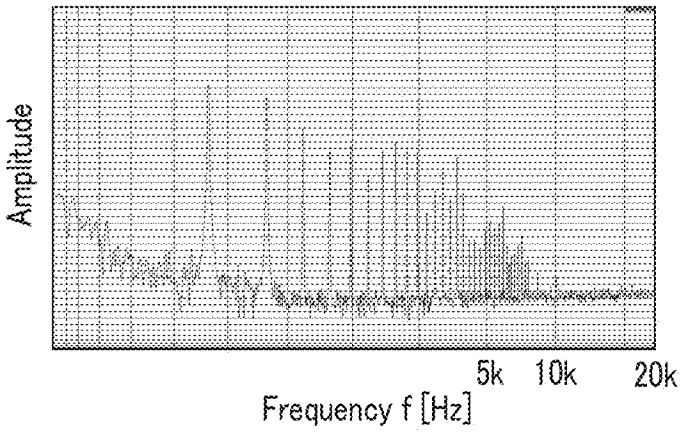

FIGS. 14A and 14B are diagrams illustrating a change in frequency spectrum characteristics at the point of key-release. FIG. 14A illustrates distribution characteristics of a frequency spectrum in the state of note-on immediately before key-release. FIG. 14B illustrates distribution characteristics of a frequency spectrum during key-release.

FIG. 14A shows distribution characteristics of a frequency spectrum immediately before key-release in the present embodiment.

FIG. 14B shows distribution characteristics of a frequency spectrum during key-release in the present embodiment. When the present embodiment is used, it is possible to confirm that frequency components (primarily, in the vicinity of 10 kHz) which did not appear immediately before the key-release have appeared as shown in an XIV portion in the range shown in the figure. More specifically, according to the present embodiment, it can be said that even-numbered order overtone components of a key note frequency (e.g., 200 Hz) of a pitch according to key pressing are generated moderately in accordance with key-release, and it can be seen that musical sound having characteristics which closely resemble sound of an acoustic piano at the point of key-release can be obtained. This sound approximates to the braking component sound generated when a damper (a compressed felt) comes into contact with a string (piano wire), and it is considered that the musical sound of an acoustic piano was able to be extremely naturally reproduced.

According to the present embodiments as described above in detail, it becomes possible to generate musical sound with a real sound quality without increasing the circuit scale.

The embodiment described above includes a plurality of signal circulation circuits, each of which generates a musical sound waveform for one note number and is configured to output a musical sound waveform after adding musical sound waveforms generated in the respective signal circulation circuits; it is therefore possible to faithfully reproduce musical sound of a musical instrument which sounds a plurality of strings and pipes for a single note number operation.

Furthermore, in the embodiment described above, waveform data as an excitation signal read out from a waveform memory is subjected to window-multiplying processing and then output to signal circulation circuits which generate musical sound waveforms, and therefore, unnecessary frequency components are removed, enabling simplification of the configuration of circuits for performing signal processing.

In addition, in the embodiment described above, waveform data itself to be stored in a waveform memory is subjected to window-multiplying processing in advance and then stored, and therefore, it is possible to reduce storage capacity, etc. necessary for the waveform memory.

The embodiment described enables reduction in memory capacity, etc., necessary for the waveform memory, since the embodiment is configured to generate musical sound having a necessary length according to the operation at a playing operator, via a signal circulation circuit from musical sound waveform information for a predetermined wave length read out from the waveform memory.

Furthermore, the embodiment is configured such that after receipt of playing operation information including a note number and musical sound intensity, a predetermined wavelength portion in a necessary range is acquired from musical sound wavelength information which is stored in the waveform memory and changes according to a plurality of sound intensities, so that the circuit configuration for reading the musical sound waveform information can be simplified.

More specifically, the embodiment is configured to acquire the predetermined wavelength portion by changing an address read out, based on the received playing operation information from a memory in which musical sound waveform information which is changed according to a plurality of sound intensities, so that the circuit for obtaining necessary musical sound waveform information can be made simpler.

The embodiment described above can more faithfully reproduce and generate original musical sound, since the embodiment is configured such that a register in which a plurality of signal circulation circuits are provided for a single note number is made pursuant to a musical instrument used as a model.

As described above, the present embodiment describes a case where the embodiment applies to an electronic keyboard instrument; however, the present invention is not limited to a particular instrument or a particular model.

The invention of the present application is not limited to the embodiment described above, and can be modified variously modified in the implementation stage without departing from the scope of the invention. In addition, the embodiments may be suitably implemented in combination, in which case a combined effect is obtained. Furthermore, inventions in various stages are included in the above-described embodiments, and various inventions can be extracted by a combination selected from a plurality of the disclosed configuration requirements. For example, even if some configuration requirements are removed from all of the configuration requirements shown in the embodiments, the problem described in the column of the problem to be solved by the invention can be solved, and if an effect described in the column of the effect of the invention is obtained, a configuration from which this configuration requirement is removed can be extracted as an invention.

What is claimed is:

1. An electronic musical instrument comprising:

a playing operator with which pitch information indicating a certain pitch is associated;

a memory in which excitation signal waveform data corresponding to the certain pitch is stored in advance, wherein the excitation signal waveform data that is stored in advance is generated by combining, in time series, portions of a plurality of waveform data items corresponding to the certain pitch and which are respectively different from each other in sound intensity; and a sound source which performs processing of:

receiving, in response to a user operation on the playing operator, a sound generation instruction according to playing operation information including the pitch information indicating the certain pitch and sound volume information indicating a certain volume, and generating sound according to the certain pitch and the certain volume, based on excitation data generated by multiplying partial data by a window function, the partial data being included in the excitation signal waveform data corresponding to the certain pitch and that is stored in advance in the memory.

2. The electronic musical instrument according to claim 1, wherein the partial data is data extracted from the excitation signal waveform data in accordance with the sound volume information, and the sound source circulates the excitation data to generate the sound according to the certain pitch and the certain volume.

3. The electronic musical instrument according to claim 1, wherein the sound source reads, in response to the sound generation instruction according to the playing operation information, the partial data according to the sound volume information from the excitation signal waveform data stored in advance in the memory, and generates the excitation data by multiplying the read partial data by the window function.

4. The electronic musical instrument according to claim 1, wherein the sound source delays the excitation data for a time determined in accordance with the pitch information and circulates the excitation data.

5. The electronic musical instrument according to claim 1, wherein a plurality of the excitation signal waveform data is stored in advance in the memory, and the sound source selects any one of the plurality of the excitation signal waveform data in accordance with the pitch information.

6. The electronic musical instrument according to claim 1, wherein a time width of a waveform of the partial data read in the sound source differs in accordance with the pitch information, and a time width of a window of the window function also differs in accordance with the pitch information.

7. The electronic musical instrument according to claim 1, wherein a time width of partial data corresponding to a certain pitch read in the sound source is longer than a time width of partial data corresponding to a pitch higher than the certain pitch, and a time width of a window of a window function corresponding to the certain pitch is longer than a time width of a window of a window function corresponding to the pitch higher than the certain pitch.

8. The electronic musical instrument according to claim 1, further comprising a plurality of signal circulation circuits which circulate the excitation data, wherein a number of the signal circulation circuits which circulate the excitation data is determined in accordance with pitch information received.

9. The electronic musical instrument according to claim 1, further comprising:

a plurality of signal circulation circuits for performing signal circulation processing of the excitation data, and a keyboard which includes, as playing operators, at least a first key corresponding to a first pitch, a second key corresponding to a second pitch, and a third key corresponding to a third pitch, wherein:

a number of the signal circulation circuits corresponding to the first key used for the signal circulation processing is one;

a number of the signal circulation circuits corresponding to the second key used for the signal circulation processing is two; and a number of the signal circulation circuits corresponding to the third key used for the signal circulation processing is three.

10. The electronic musical instrument according to claim 1, wherein the excitation signal waveform data is generated by synthesizing at least first waveform data in the certain pitch and second waveform data in the certain pitch, the second waveform data having a sound intensity weaker than a sound intensity of the first waveform data.

11. The electronic musical instrument according to claim 1, wherein the plurality of waveform data items comprise waveform data of a plurality of sounds corresponding respectively to playing operations of different sound intensities, and the excitation signal waveform data is generated by subjecting the waveform data of the plurality of sounds to amplitude normalization processing and sequentially joining them.

12. The electronic musical instrument according to claim 1, wherein the plurality of waveform data items comprise waveform data of a plurality of sounds corresponding respectively to playing operations of different sound intensities, the waveform data of each waveform data item being extracted from an interval where an overtone component is stabilized among waveforms of sounds changing with time after the corresponding playing operation, wherein each piece of excitation signal waveform data is generated by sequentially joining said plurality of waveform data items.

13. The electronic musical instrument according to claim 1, wherein the plurality of waveform data items comprise waveform data of a plurality of sounds corresponding respectively to playing operations of different sound intensities with respect to a model instrument, wherein an amplitude of the waveform data of the plurality of sounds is uniformed and normalized, the waveform data of each waveform data item being extracted from an interval where an overtone component is stabilized among waveforms of sounds changing with time after the corresponding playing operation, wherein each piece of excitation signal waveform data is generated by sequentially joining said plurality of waveform data items.

14. The electronic musical instrument according to claim 1, wherein the window function is a function which has less influence on overtone components of original sound.

15. The electronic musical instrument according to claim 1, wherein a time width of a window of the window function is predetermined in advance for the certain pitch, whereby the time width of the window of the window function for the certain pitch by which the partial data is multiplied is set irrespective of a duration of the user operation on the playing operator.

16. The electronic musical instrument according to claim 1, wherein a read address of the partial data within the excitation signal waveform data is offset from a leading address by an offset value that is determined according to the sound volume information.

17. An electronic musical instrument comprising:

a memory;

a plurality of keys, the plurality of keys respectively being associated with pitch information; and at least one processor that performs processing of:

receiving, in response to a user operation on a key among the plurality of keys, a sound generation instruction according to playing operation information including pitch information associated with the key and indicating a certain pitch and sound volume information indicating a certain volume, and generating sound according to the certain pitch and the certain volume, based on excitation data generated by multiplying partial data by a window function, the partial data being included in excitation signal waveform data corresponding to the certain pitch and that is stored in advance in the memory, wherein the excitation signal waveform data that is stored in advance in the memory is generated by combining, in time series, portions of a plurality of waveform data items corresponding to the certain pitch and which are respectively different from each other in sound intensity.

18. A method of causing an electronic musical instrument, which includes (i) a playing operator with which pitch information indicating a certain pitch is associated, (ii) a memory in which excitation signal waveform data corresponding to the certain pitch is stored in advance, wherein the excitation signal waveform data that is stored in advance is generated by combining, in time series, portions of a plurality of waveform data items corresponding to the certain pitch and which are respectively different from each other in sound intensity, and (iii) a sound source, to perform processing by the sound source, the method comprising:

receiving, in response to a user operation on the playing operator, a sound generation instruction according to playing operation information including the pitch information indicating the certain pitch and sound volume information indicating a certain volume, and generating sound according to the certain pitch and the certain volume, based on excitation data generated by multiplying partial data by a window function, the partial data being included in the excitation signal waveform data corresponding to the certain pitch and that is stored in advance in the memory.

19. The method according to claim 18, further comprising:

extracting the partial data from the excitation signal waveform data in accordance with the sound volume information, and circulating the excitation data to generate the sound according to the certain pitch and the certain volume.

20. The method according to claim 18, wherein the method further comprises reading, in response to the sound generation instruction according to the playing operation information, the partial data according to the sound volume information from the excitation signal waveform data stored in advance in the memory, and generating the excitation data by multiplying the read partial data by the window function.

21. The method according to claim 18, further comprising delaying the excitation data for a time determined in accordance with the pitch information and circulating the excitation data.

* * * * *